US006523812B1

(12) United States Patent
Spinks et al.

(10) Patent No.: US 6,523,812 B1
(45) Date of Patent: Feb. 25, 2003

(54) SPRING UNITS

(75) Inventors: Peter Douglas Spinks, Sherburn-in-Elmet (GB); Simon Paul Spinks, Sherburn-in-Elmet (GB)

(73) Assignee: A Harrison (Bedding) Limited, Leeds (GB)

( * ) Notice: Subject to any disclaimer, the term of this patent is extended or adjusted under 35 U.S.C. 154(b) by 0 days.

(21) Appl. No.: 09/700,235

(22) PCT Filed: Jun. 28, 1999

(86) PCT No.: PCT/GB99/02015

§ 371 (c)(1),
(2), (4) Date: Nov. 10, 2000

(87) PCT Pub. No.: WO00/00065

PCT Pub. Date: Jan. 6, 2000

(30) Foreign Application Priority Data

Jun. 27, 1998 (GB) ..... 9813805

(51) Int. Cl.[7] ..... F16F 3/00

(52) U.S. Cl. ..... 267/80; 267/166; 5/655.8; 5/720; 53/114

(58) Field of Search ..... 267/80, 166; 5/655.8, 5/720; 53/114, 550, 555

(56) References Cited

U.S. PATENT DOCUMENTS

| | | | | | |
|---|---|---|---|---|---|
| 871,871 | A | * | 11/1907 | Hirschman | 267/92 |
| 1,192,510 | A | * | 7/1916 | Breckle | 5/477 |
| 1,563,692 | A | * | 12/1925 | Denham | 267/111 |
| 1,602,197 | A | * | 10/1926 | Kramer | 5/655.8 |
| 1,621,091 | A | * | 3/1927 | Suekoff | 29/91.1 |
| 1,703,587 | A | * | 2/1929 | Kraft | 5/252 |
| 1,741,847 | A | * | 12/1929 | Kaspar | 5/353 |
| 2,257,994 | A | * | 10/1941 | Zofnass | 5/351 |
| 2,461,062 | A | * | 2/1949 | Kane | 5/353 |
| 3,462,779 | A | * | 8/1969 | Thompson | 5/353 |
| 3,633,228 | A | * | 1/1972 | Zysman | 267/143 |
| 3,674,115 | A | * | 7/1972 | Young et al. | 188/1 |
| 4,245,362 | A | * | 1/1981 | Mueller | 267/160 |
| 4,245,363 | A | * | 1/1981 | Callaway | 267/160 |
| 4,451,949 | A | * | 6/1984 | Stumpf | 5/477 |
| 4,462,129 | A | * | 7/1984 | Brannock | 267/105 |
| 4,485,506 | A | * | 12/1984 | Stumpf et al. | 267/83 |
| 4,986,518 | A | * | 1/1991 | Stumpf | 267/91 |
| 5,127,635 | A | * | 7/1992 | Long et al. | 267/91 |
| 5,699,998 | A | * | 12/1997 | Zysman | 267/189 |
| 6,029,957 | A | * | 2/2000 | Zysman | 267/89 |
| 6,056,278 | A | * | 5/2000 | Bullard et al. | 267/91 |
| 6,122,900 | A | * | 9/2000 | Mossbeck et al. | 53/529 |
| 6,175,997 | B1 | * | 1/2001 | Mossbeck | 29/91 |
| 6,256,820 | B1 | * | 7/2001 | Moser et al. | 267/166 |

FOREIGN PATENT DOCUMENTS

| | | | | |
|---|---|---|---|---|
| WO | 98/25503 | * | 6/1998 | 5/353 |
| WO | WO 99/34712 | * | 7/1999 | 5/720 |
| WO | WO 99/35081 | * | 7/1999 | 5/720 |

* cited by examiner

*Primary Examiner*—Jack Lavinder
*Assistant Examiner*—Benjamin A Pezzlo
(74) *Attorney, Agent, or Firm*—Klauber & Jackson

(57) ABSTRACT

The invention discloses a spring unit for use in a sprung unit such as a bed, divan bed, mattress, or other upholstered unit, the spring unit comprising a pocket of fabric or other suitable material and having at least two sub-pockets, each of said sub-pockets containing a resilient member. The pocket will preferably be divided across, laterally, or diagonally so as to form said at least two sub-pockets. The spring unit may be formed with two sub-pockets or three or more sub-pockets each containing a resilient member. The sub-pockets may be of equal length or of differing lengths, and the resilient members will preferably be springs which may be of equal lengths or of differing lengths and of equal or differing rates of compression. The pocket will be divided by fabric or other suitable material which is integral with the pocket or by discrete piece(s) of fabric or other suitable material secured to said pocket to form said sub-pockets.

21 Claims, 2 Drawing Sheets

SPRING UNITS

This invention relates to spring units for use in sprung units such as, for example, beds, divan beds, mattresses, upholstered items and the like, and the invention is more particularly concerned with pocketted spring units for use in such articles.

A pocketted spring unit generally consists of a pocket of fabric or other suitable material in which is located a spring, the ends of the pocket being closed so as to retain the spring within the pocket. Such a pocketted spring unit comprises a single pocket and a single spring within said pocket, a plurality of such pocketted spring units being used in the formation of a sprung unit such as is referred to above.

In publication No WO 98/25503 there is disclosed a composite spring unit for incorporation into a bed, divan bed, mattress or other upholstered unit, the composite spring comprising a first pocket containing a spring and a second pocket containing a spring, the second pocket being wholly within the first pocket and being such that the second pocket and its spring is freely movable within and relative to the first pocket.

In U.S. Pat. No. 3,462,779 there is disclosed a cushion comprising two spring layers which are separated by a resilient layer of deformable material, each spring layer consisting of a plurality of what may be termed 'spring units'. Each of the 'spring units' includes a plurality of coil springs which are positioned in a side-by-side relationship, the coil springs being located between discrete segments of spring covering material, the segments being seamed together along the edges of the material and laterally of the material so as to isolate the springs within the material one from the other. In each of the 'spring units', the springs are located side-by-side such that the springs of each 'spring unit' are not co-axial, and in addition the pocket containing the coil springs is not formed from one piece of material.

Because the coil springs in the 'spring units' disclosed in U.S. Pat. No. 3,462,779 are in side-by-side relationship within the 'spring unit', they are considered to be unsuitable for use in the construction of a bed, divan bed, or mattress, since the 'spring units' would not function in the desired way.

Also, as the second spring in publication No WO 98/25503 is freely movable within the first spring, it is not possible to control the movement of the second spring within the first spring.

The present invention seeks to provide an improved form of spring unit which will obviate the disadvantages of known spring units.

According to the present invention there is provided a spring unit comprising a pocket of fabric or other suitable material and having at least two sub-pockets, each of said sub-pockets containing a resilient member, said pocket being formed from a single piece of fabric or other suitable material and said resilient members being mutually co-axial.

Said pocket will preferably be divided across laterally, or diagonally. Said resilient members will preferably be springs, and said sub-pockets may be of equal length or of differing lengths.

Said pocket will preferably be divided by fabric or other suitable material which is integral with the fabric or other suitable material of said pocket. Alternatively, said pocket may be divided by discrete piece(s) of fabric or other material which is secured to said pocket so as to form said sub-pockets.

Said springs, at least when housed or contained in said sub-pockets, and/or prior to being housed or contained in said sub-pockets, will be of equal or unequal lengths, and said springs will have equal or differing rates of compression.

In order that the invention may be more readily understood, embodiments thereof will now be described, by way of example only, reference being made to the accompanying drawings, wherein.

Throughout the following description and in the ensuing claims, the term 'pocket' is to be taken to include a single pocket formed from a single piece or a plurality of pieces of fabric or other suitable material, or two or more pockets secured together to form a single composite pocket, so the description and claims should be construed accordingly.

Figure 1:
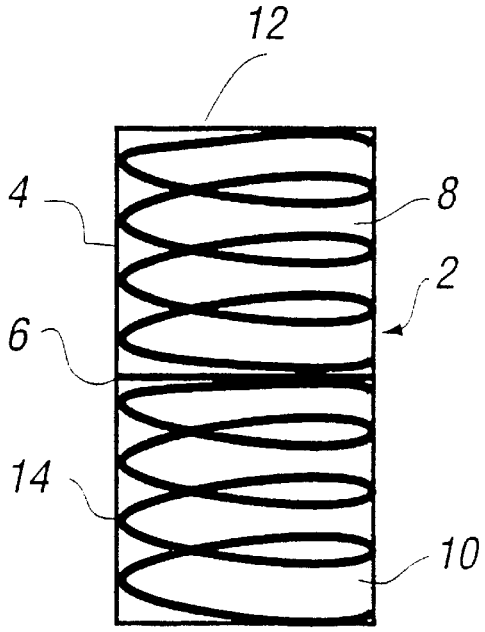
FIG. 1 is a schematic representation of a spring unit according to a first embodiment of the invention.

Referring to the drawings, and firstly to FIG. 1, a spring unit, indicated generally by reference numeral 2, comprises a single pocket 4 of fabric or other suitable material which is closed at its extremities and which is divided laterally by a length or web of the fabric or other suitable material—indicated by reference numeral 6—so as to form in said pocket 4 two sub-pockets 8 and 10. As will be seen, the sub-pockets are of the same length or substantially of the same length.

The length or web 6 of fabric or other suitable material is integral with the fabric or other suitable material of the pocket 4, and is formed or positioned by heat welding, sonic welding, or stitching during the formation of the spring unit.

Located in each of the sub-pockets 8 and 10 is a coil spring 12 and 14 respectively, the springs being retained in the sub-pockets by the length or web 6 and the closed extremities of the sleeve.

The springs 12 and 14, both in their uncompressed states and when located in their respective sub-pocket, will preferably be of the same length and have equal rates of compression, but it will be understood that the springs 12 and 14, at least when not located in the sub-pockets, may be of differing lengths, and in addition may have differing rates of compression.

Figure 2:
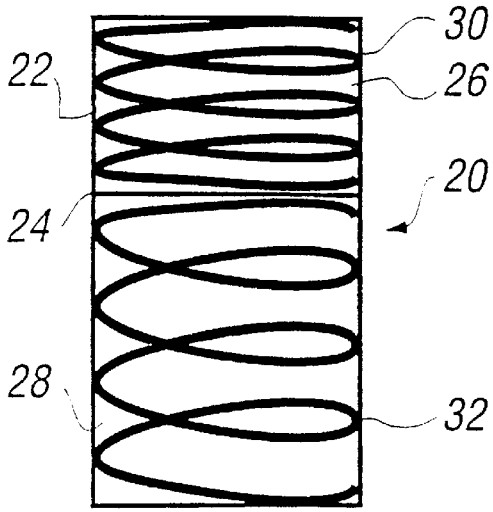
FIGS. 2 to 6 illustrate further embodiments of the invention.

Referring now to FIG. 2, a spring unit, indicated generally by reference numeral 20, is essentially the same as the spring unit of FIG. 1, in that the spring unit comprises a single pocket 22 of fabric or other suitable material, is closed at its extremities, and has a lateral length or web 24 of fabric or other material so as to form in said pocket 22 two sub-pockets 26 and 28. As will be seen from FIG. 2, the lengths of said sub-pockets 26 and 28 are different, that of the upper sub-pocket 26 being less than that of the lower sub-pocket 28.

Each of the sub-pockets 26 and 28 contain a spring, respectively referenced 30 and 32, the springs being retained in position as described above with reference to FIG. 1.

As will be seen, the spring 32 is of a greater length than the spring 30 when the springs are housed or contained in the sub-pockets 28 and 26, although it will be appreciated that the springs may be of equal length or differing lengths when free of said sub-pockets, and as referred to in connection with FIG. 1, the rates of compression of the springs 30 and 32 may be the same or such rates of compression may be different.

Figure 3:
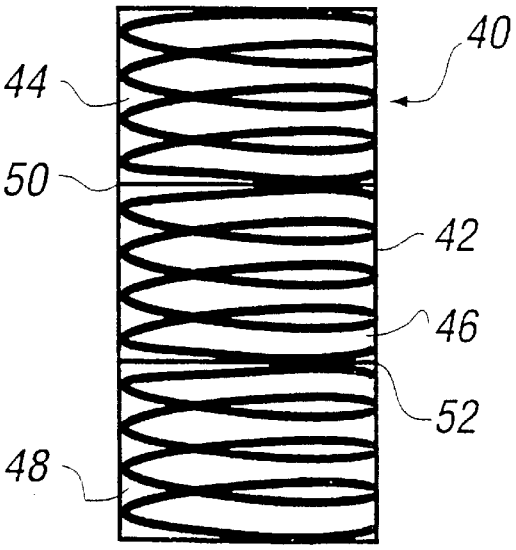

FIG. 3 shows a 'three-up' spring unit, indicated generally by reference numeral 40, which comprises a single pocket 42 which is divided into three sub-pockets 44, 46, and 48 by lateral lengths or webs 50 and 52, the lengths or webs being integral with the fabric or other suitable material of the pocket 42. As will be seen, the sub-pockets 44, 46, and 48 are of equal or substantially equal length.

Each of the sub-pockets 44, 46, and 48 contain a spring, respectively referenced 54, 56, and 58 which, when located in their respective sub-pockets, are of the same length. It will be appreciated however, that in their free states the springs may of equal or differing lengths. In addition, and as previously referred to, the rates of compression of the springs may be the same or they may differ.

Figure 4:
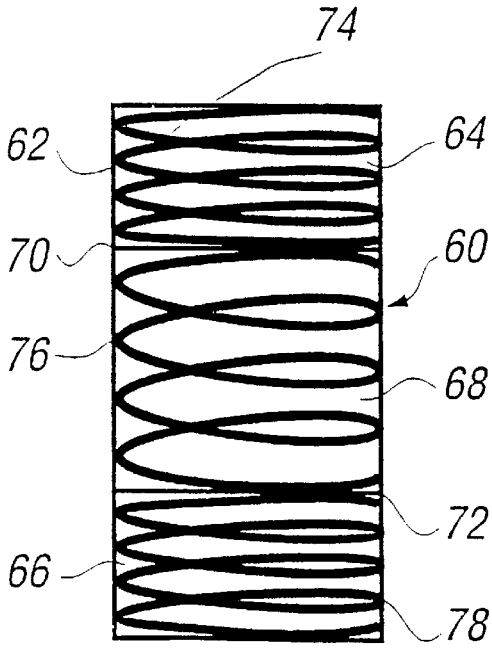

FIG. 4 shows a variation of the spring unit of FIG. 3, the spring unit 60 in this case having equal length upper and lower sub-pockets 64 and 66, and an intermediate sub-pocket 68 located between said upper and lower sub-pockets, formed in the pocket 62. The sub-pockets 64, 66, and 68 are formed as previously described by integral lengths or webs 70 and 72.

Springs 74, 76, and 78 are located in the sub-pockets 64, 66, and 68, and as previously referred described, the springs may have the same length or differing lengths, and their rates of compression may be the same or different.

Figure 5:
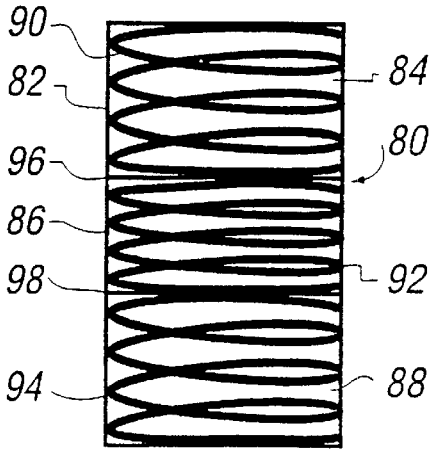

FIG. 5 illustrates a variation of the spring unit of FIG. 4. In the embodiment of FIG. 5, the spring unit 80 has a pocket 82 divided into three sub-pockets 84, 86, and 88 by lengths or webs 96 and 98 integral with the fabric or other material of the pocket, the sub-pockets 84 and 88 being of the same length and of a greater length than the sub-pocket 86.

The springs 90, 92 and 94 located in the respective sub-pockets 84, 86, and 88 may have varying lengths when not located in the sub-pockets or they may be all of the same length, and their rates of compression may, as with the previous embodiments, be the same or they may differ.

In each of the above-described embodiments, instead of the lengths or webs of fabric or other material being integral with the fabric or other material of the pocket, such lengths or webs may be constituted by discrete pieces of fabric or other material suitably secured in position to the pocket.

Figure 6:
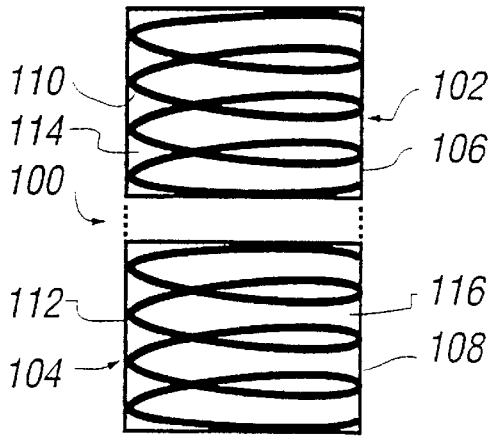

Referring now to FIG. 6, this illustrates a spring unit indicated generally by reference numeral 100 which consists of two seperate spring units 102 and 104, each comprising respectively a pocket 106 and 108, having closed upper and lower extremities, and housing or containing a spring 110 and 112, the pockets being joined together at the juncture of the lower extremity 106A of the upper pocket 106 and the upper extremity 108A of the lower pocket 108 so as to form a single composite pocket containing two sub-pockets referenced 114 and 116.

The sub-pockets 114 and 116 are of equal or substantially equal length, and the springs contained therein, whilst of the same length when located or housed in said sub-pockets, may be of differing lengths or of the same length when free of said sub-pockets. In addition, the rates of compression of said springs may be the same or they may differ.

Although the springs illustrated in FIGS. 1 to 6 are shown as being coil springs, it will be appreciated that such springs may be barrel springs, or indeed any other suitable form of spring or other resilient means such as foam or other resilient material pads.

It will be appreciated that whilst FIGS. 1 to 6 show the length or web of fabric or other suitable material extending laterally, i.e. from side to side, of the pocket and generally parallel to the ends of the pocket, the length or web of fabric or other material may extend between diagonally opposed 'corners' of the pocket and/or at any suitable position between that position and the positions illustrated in FIGS. 1 to 6.

Figure 7:
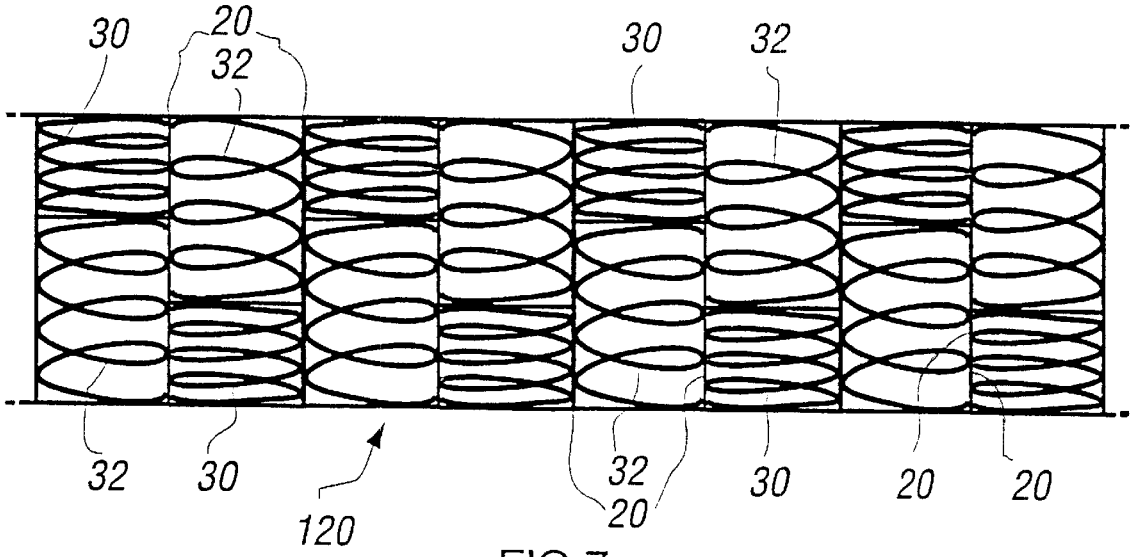
FIG. 7 illustrates one example of a sprung unit incorporating a plurality of spring units according to the invention.

FIG. 7 illustrates part of a sprung unit 120—for example a bed, divan bed, or mattress—which incorporates a plurality of the spring units according to the invention. The illustration shows the sprung unit 120 incorporating a plurality of the spring units 20 of FIG. 2. It will be seen that the spring units 20 are arranged such that adjacent spring units are in reversed positions, i.e. the spring 30 of one unit is upper-most, whilst in the adjacent spring unit the spring 32 is uppermost.

Thus the sprung unit is given a variation in firmness at different stages of compression of the spring units throughout the sprung unit when a user's weight is applied to the sprung unit. This is due to the fact that, for example, the springs 30 will not be compressed further until such time that the springs 32 have been compressed and are substantially the same length as the springs 30.

It will be appreciated that the spring units within the sprung unit 120 may all have the same orientation, i.e. the springs 30 will always be uppermost and the springs 32 lowermost or vice versa.

It will also be appreciated that the sprung unit 120 may incorporate a plurality of the spring units of FIG. 1 or of any of FIGS. 3 to 6, or indeed any combination of the spring units of FIGS. 1 to 6.

Thus the invention provides spring units for incorporation into a sprung unit, the form of the spring unit and the arrangement of a plurality of spring units within the sprung unit giving the sprung unit a variable 'spring count' and a variation in the firmness at different stages of compression of the springs of said spring units.

What is claimed is:

1. A spring unit comprising a single pocket of fabric, said single pocket being divided across so as to form discrete sub-pockets within said single pocket, the division of said single pocket to form said sub-pockets being by means of one of: (a) a second fabric which is integral with said fabric of said single pocket; and (b) by a second fabric being secured to said fabric of said single pocket;

wherein each of said sub-pockets contain a resilient member contacting one of: (a) said single pocket; and (b) said second fabric.

2. A spring unit according to claim 1, wherein said single pocket is divided across laterally so as to form said sub-pockets.

3. A spring unit according to claim 1, wherein said single pocket is divided across diagonally so as to form said sub-pockets.

4. A spring unit according to claim 1, wherein said resilient member is a spring.

5. A spring unit according to claim 2, wherein said single pocket is divided across laterally to form two sub-pockets each containing a spring.

6. A spring unit according to claim 2, wherein said single pocket is divided across laterally to form three or more sub-pockets each containing a spring.

7. A spring unit according to claim 5, wherein said sub-pockets are of equal length.

8. A spring unit according to claim 6, wherein said sub-pockets are of equal length.

9. A spring unit according to claim 5, wherein said sub-pockets are of differing lengths.

10. A spring unit according to claim 6, wherein said sub-pockets are of differing lengths.

11. A spring unit according to claim 5, wherein said springs are of equal length prior to and when housed or contained in said sub-pockets.

12. A spring unit according to claim 6, wherein said springs are of equal length prior to and when housed or contained in said sub-pockets.

13. A spring unit according to claim 5, wherein said springs are of differing lengths prior to being housed in said sub-pockets.

14. A spring unit according to claim 6, wherein said springs are of differing lengths prior to being housed in said sub-pockets.

15. A spring unit according to claim 5, wherein said springs are of equal length prior to being housed or contained in their respective sub-pockets.

16. A spring unit according to claim 6, wherein said springs are of equal length prior to being housed or contained in their respective sub-pockets.

17. A spring unit according to claim 5, wherein said springs are of different lengths both prior to and when housed or contained in their respective sub-pockets.

18. A spring unit according to claim 6, wherein said springs are of different lengths both prior to and when housed or contained in their respective sub-pockets.

19. A spring unit according to claim 1, wherein said springs have the same rate of compression.

20. A spring unit according to claim 1, wherein said springs have differing rates of compression.

21. A spring unit such as a bed, divan bed mattress or other upholstered unit incorporating a plurality of springs according to claim 1.

* * * * *